United States Patent [19]

Maruoka

[11] 4,183,337

[45] Jan. 15, 1980

[54] AIR-FUEL MIXTURE RATIO CONTROL USING ELECTROSTATIC FORCE

[75] Inventor: Hiroyuki Maruoka, Yokohama, Japan

[73] Assignee: Nissan Motor Company, Limited, Yokohama, Japan

[21] Appl. No.: 784,722

[22] Filed: Apr. 5, 1977

[30] Foreign Application Priority Data

| | | | |
|---|---|---|---|
| Apr. 6, 1976 | [JP] | Japan | 51-37729 |
| Apr. 6, 1976 | [JP] | Japan | 51-37730 |
| May 6, 1976 | [JP] | Japan | 51-50935 |
| Jun. 28, 1976 | [JP] | Japan | 51-75584 |

[51] Int. Cl.[2] ..... F02M 7/00

[52] U.S. Cl. ..... 123/119 E; 123/119 EC

[58] Field of Search ..... 123/119 E, 119 EC

[56] References Cited

U.S. PATENT DOCUMENTS

| | | | |
|---|---|---|---|
| 4,051,826 | 10/1977 | Richards | 123/119 E X |

FOREIGN PATENT DOCUMENTS

| | | | |
|---|---|---|---|
| 2461126 | 10/1975 | Fed. Rep. of Germany | 123/119 E |
| 2428967 | 1/1976 | Fed. Rep. of Germany | 123/119 E |
| 2433125 | 1/1976 | Fed. Rep. of Germany | 123/119 E |
| 2449848 | 5/1976 | Fed. Rep. of Germany | 123/119 E |
| 2521141 | 11/1976 | Fed. Rep. of Germany | 123/119 E |

*Primary Examiner*—Wendell E. Burns

*Attorney, Agent, or Firm*—Schwartz, Jeffery, Schwaab, Mack, Blumenthal & Koch

[57] ABSTRACT

Electrostatically charged liquid fuel is introduced into a venturi to be atomized therein and is then applied to the combustion chambers of an engine under the control of electrostatic force for properly controlling the air-fuel mixture ratio.

39 Claims, 23 Drawing Figures

AIR-FUEL MIXTURE RATIO CONTROL USING ELECTROSTATIC FORCE

BACKGROUND OF THE INVENTION

The present invention relates generally to an arrangement for use with an internal combustion engine, and particularly to such an arrangement for controlling an air-fuel mixture ratio by means of electrostatic force.

Several systems or arrangements have been proposed to effectively reduce noxious components contained in exhaust gases from an internal combustion engine. Each of such systems or arrangements requires considerably large changes in a carburetor and/or combustion chambers, resulting in the fact that it is complicated in structure and therefore expensive.

SUMMARY OF THE INVENTION

A primary object of the present invention is to provide an improved arrangement for use with an internal combustion engine for effectively controlling an air-fuel mixture ratio by means of electrostatic force.

Another object of the present invention is to provide an improved arrangement for use with an internal combustion engine, which arrangement concentrates a rich air-fuel mixture in the vicinity of electrodes of a spark plug by means of electrostatic force.

Another object of the present invention is to provide an improved arrangement for use with an internal combustion engine, which arrangement controls the air-fuel ratio of the air-fuel mixture fed to each of the combustion chambers by means of electrostatic force.

These and other objects, features and many of the attendant advantages of this invention will be appreciated more readily as the invention becomes better understood from the following detailed description, wherein like parts in each of the several figures are identified by the same reference characters.

DETAILED DESCRIPTION OF PREFERRED EMBODIMENTS

Figure 1:
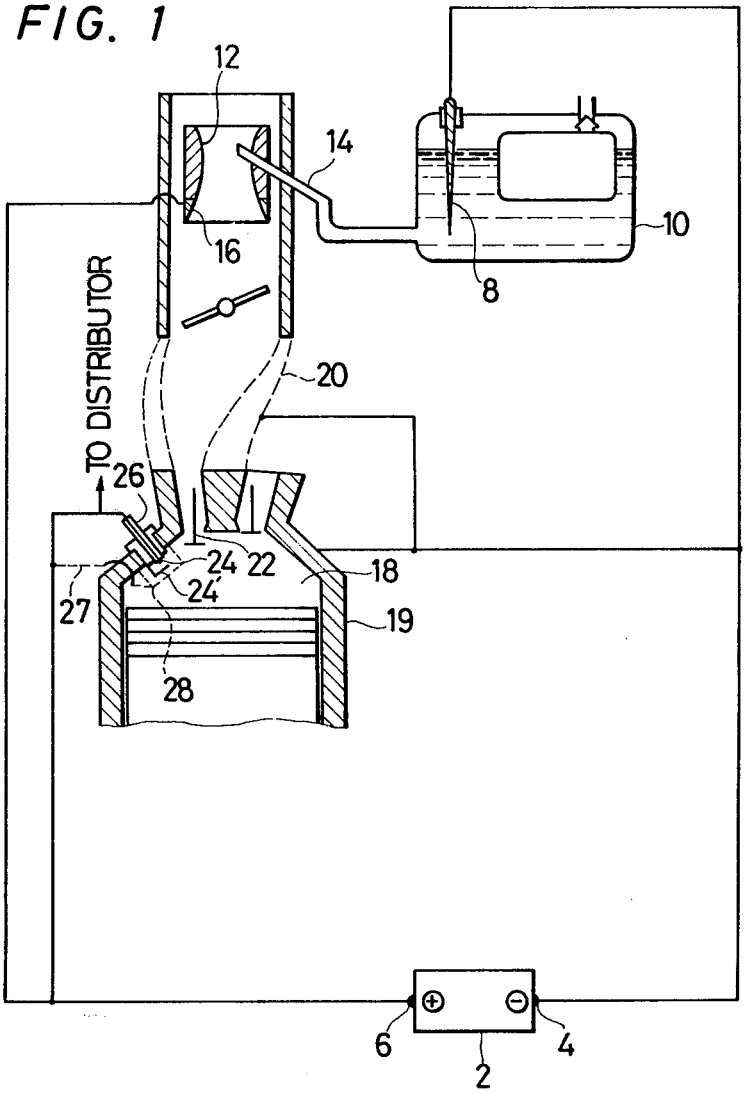
FIG. 1 is a schematic illustration of a first preferred embodiment of the present invention.

Reference is now made to FIG. 1, which illustrates schematically a first preferred embodiment of the present invention. An electrostatic charging means 2 such as a high d.c. voltage supply is connected through its negative output terminal 4 to an electrode 8 of the needle type which protrudes into a float bowl 10 in order to charge a liquid fuel confined in the float bowl. The output potential of the charging means 2 is usually within a range from several thousands to tens of thousands of volts. The charged liquid fuel is then introduced into a venturi 12 through a main nozzle 14. The charged liquid fuel, as is well known in the art, is atomized in the venturi more easily than the non-charged fuel. It is preferable that another electrode 16, which is connected to the electrostatic charging means 2 through a positive output terminal 6, is provided in the vicinity of the main nozzle 4 for accelerating the charged fuel droplets. In FIG. 1, the electrode 16 is a portion of the venturi 12 and electrically insulated from the remainder of the venturi 12 which is made of dielectric material, but can be provided independently of the venturi 12 although this embodiment is not illustrated. The atomized fuel is mixed with air from an air cleaner (not shown) and then fed to a cylinder 18 through both an intake passage 20 and an intake port 22. The center electrode 24 of a spark plug 26 is connected to the electrostatic charging means 2 through the positive output electrode 6 so as to make the air-fuel mixture rich in the vicinity thereof due to the electrostatic attractive force between the positively charged electrode 24 and the negatively charged fuel droplets, thereby making it easy to ignite the air-fuel mixture. Therefore, according to the present embodiment, a considerably lean air-fuel mixture can be easily ignited so that this embodiment is advantageous when used with a so called two-stage combustion system or an exhaust gas recirculation system. The two-stage combustion is, in this specification, defined applying the rich air-fuel mixture to one group of combustion chambers while applying the lean air-fuel mixture to the remainder of the combustion chambers. It is known that nitrogen oxides ($NO_x$) can be effectively reduced by this measure.

As shown in FIG. 1, it is preferable that the intake passage 20 and the cylinder 19 are connected to the electrostatic charging means 2 through the negative output terminal 4 in order to avoid sticking of the fuel droplets to the inner walls thereof. In this case, the negatively charged cylinder 19 serves to concentrate the fuel droplets in the vicinity of the positively charged electrode 24.

The voltage applied from the electrostatic charging means 2 to the electrode 24 should be determined so as not to discharge between it and another electrode 24' or the inner wall of the cylinder 19, to remove the possibility of undesirable ignition of the air-fuel mixture. In the above, in substitution for the connection of the electrostatic charging means 2 to the center electrode 24, another electrode 28 is provided within the cylinder 19 and in the vicinity of the spark plug 26, which electrode 28 is connected to the positive output terminal 6 of the electrostatic charging means 2 as shown by a broken line 27.

As previously referred to, the voltage applied to the electrode 24 or 28 should be below a threshold value above which the undesirable firing occurs. To this end, although not shown in the drawing, suitable means such as a voltage divider is provided in order to apply an adequate potential to the electrode 24 or 28.

If the spark plug 26 is insulated from the cylinder 19, another electrode 24' of the plug 26 can be used as an electrostatic electrode for the aforesaid purpose of the present embodiment.

Figure 2A:
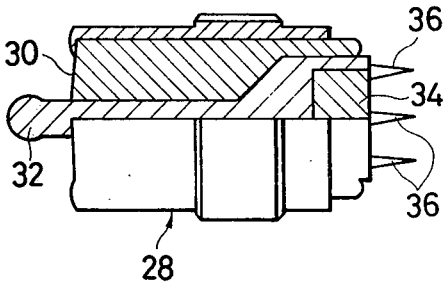
FIG. 2*a* is a side view, partly in longitudinal section, illustrating a member used in the arrangement of FIG. 1.
Figure 2B:
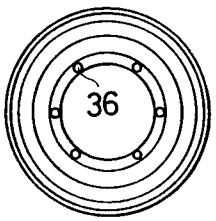
FIG. 2*b* is an elevation of the member of FIG. 2*a;*

Reference is now made to FIGS. 2*a* and 2*b*, which illustrate an example of the electrode 28 in FIG. 1. A conductive member 32 is provided for connection of electrode 36 of the needle type to the electrostatic charging means 2. The electrodes 36 are provided separately as shown in the drawings. The reason why the electrodes 36 is of needle-like configuration is that, as is well known in the art, each of the pointed portions does not otherwise produce a high electrostatic field therearound.

Figure 3:
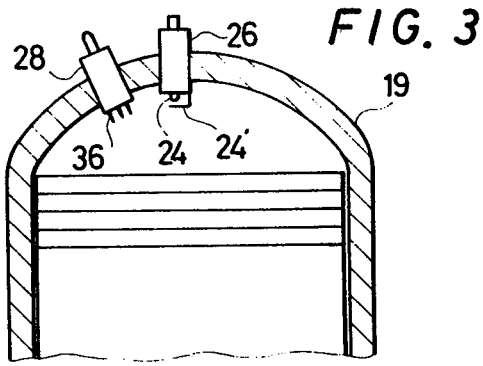
FIG. 3 shows an installation of the member of FIG. 2*a* in a cylinder.

FIG. 3 illustrates an example of an installation of the electrodes 28 in the cylinder 19.

Figure 4:
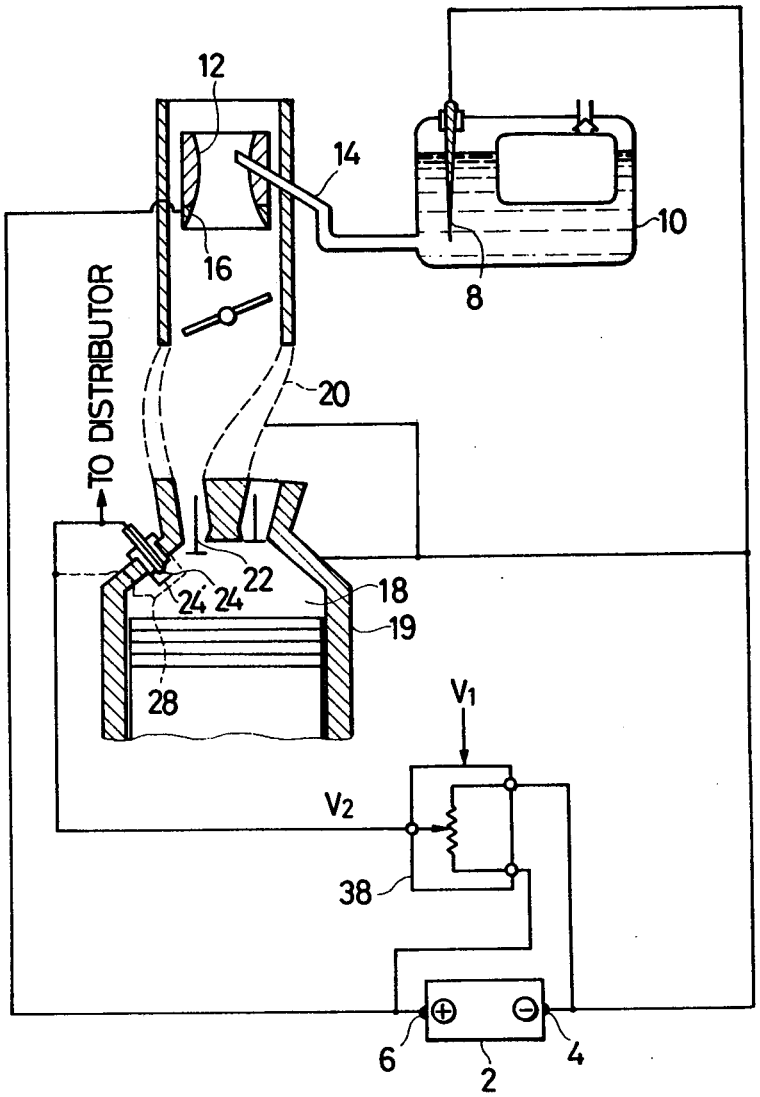
FIG. 4 illustrates a modification of the first preferred embodiment of FIG. 1.

Reference is now to FIG. 4, wherein a modification of the first preferred embodiment is illustrated. The difference between the arrangements of FIGS. 1 and 4 is that the latter is provided with a control unit 38. The control unit 38 receives a control signal $V_1$ which represents at least one engine operation parameter such an engine speed, the amount of air intake, vacuum pressure in an intake passage, or engine temperature. The control unit 38 controls, depending upon at least one control signal applied thereto, the voltage at the electrode 24 or 28. The control of the voltage of the electrode 24 or 28 has various advantages as will be described hereinafter. The threshold voltage, over which the undesired firing occurs, is controlled to be low at idling of the engine, and, on the other hand, to become high at high engine speed. More specifically, under the condition of high engine speed, it is necessary to concentrate the negatively charged droplets about the electrode 24 or 28 during a considerably short time period, so that, if the voltage applied to the electrode 24 or 28 is low at idling and high at high engine speed, control of the concentration of the air-fuel mixture around the electrode 24 or 28 can be effectively performed. In the above, although not shown in FIG. 4, it is preferable that the electrode 16 is connected to the control unit 38 in order that the voltage applied thereto is controlled, by at least one engine operation parameter, for further proper control of the concentration of the air-fuel mixture around the electrodes of the spark plug 26.

In the foregoing, the liquid fuel is negatively charged, but alternatively can be positively charged. In this case, the electrodes 16, 24, etc. should be negatively charged. Furthermore, the electrostatic charging means 2 is not restricted to a direct current power source but can be replaced by a low frequency alternating power source. On the other hand, with respect to the charging of the liquid fuel, the arrangement can be modified such that, in substitution for the electrode 8, the electrostatic charging means 2 is connected to the float bowl 10 or the nozzle 14 both made of electrically conductive material.

It is understood from the foregoing that the present embodiment is very suitable for firing the lean air-fuel mixture. More specifically, it is very suitable for use in EGR (exhaust gas recirculation) system so that the noxious component $NO_x$ can be effectively reduced.

Furthermore, in accordance with the present embodiment, a good quality of the air-fuel mixture can be obtained in that the charged liquid fuel can be readily atomized in the venturi 12.

A second preferred embodiment of the present invention will be hereinafter described in connection with FIGS. 5–10*b*. The second preferred embodiment is, in brief, concerned with two-stage combustion using the concept of electrostatic charging. The concept of two-stage combustion has been already defined. The conventional two-stage combustion system is well known in the art; however, it has several defects inherent therein: the system is complicated in structure in that two carburetors are required. This complication can be removed when a fuel injection system is used, but, the fuel injection system is expensive and causes another structural complication. In accordance with the second preferred embodiment, such defects can be removed as will be seen from the following detailed description.

Figure 5:
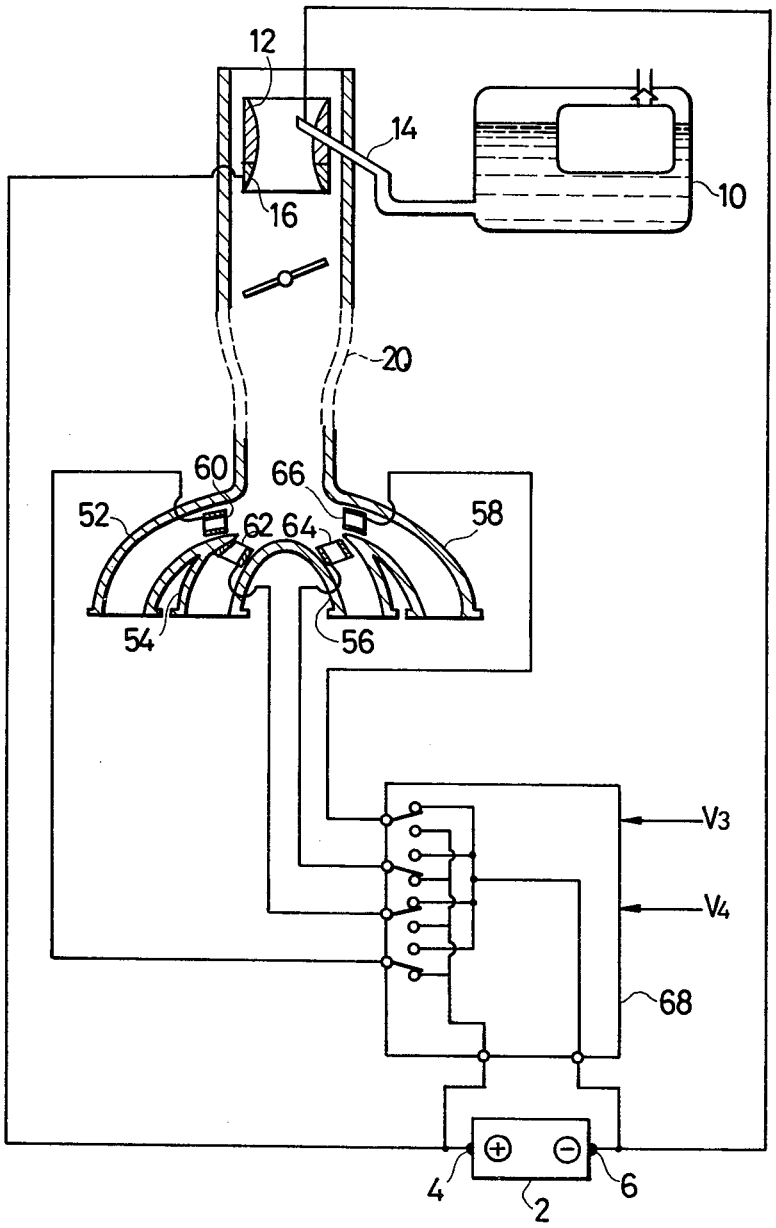
FIG. 5 is a schematic illustration of a second preferred embodiment of the present invention.

Reference is now made to FIG. 5, wherein the second preferred embodiment of the present invention is schematically illustrated. Four intake passages 52, 54, 56, and 58 are provided with four electrodes 60, 62, 64, and 66, respectively, which electrodes are connected to a control unit 68. The control unit 68 is in turn connected to the electrostatic charging means 2 for receiving the suitable direct current high voltage therefrom. The control unit 68 controls the connection of the electrostatic charging means 2 to the electrodes 60, 62, 64, and 66, depending upon control signals V3 and V4 fed thereto. The control manner of the control unit 68 will be discussed in detail later. The liquid fuel confined in the float bowl 10 is effectively positively charged while being carried through the nozzle 14, since the nozzle 14 is electrically connected to the positively output terminal 6 of the electrostatic charging means 2. The liquid fuel thus charged is supplied into the venturi 12. The air-fuel mixture formed in the venturi 12 is fed to the junction of separate intake passages 52, 54, 56, and 58. In this case, if a combustion chamber or a cylinder (not shown) connected to the intake passage 52 is in an air-intake process, the air-fuel mixture fed to the combustion chamber is rich in that the electrode 60 receives the negative voltage from the control unit 68 as seen from FIG. 5. Similarly, if a combustion chamber or a cylinder (not shown) connected to the intake passage 54 is in an air-intake process, the air-fuel mixture fed to the combustion chamber is lean in that the electrode 62 is connected to the positive output terminal of the electrostatic charging means 2 through the control unit 68.

This applies to the intake passages 56 and 58, respectively.

Figure 15:
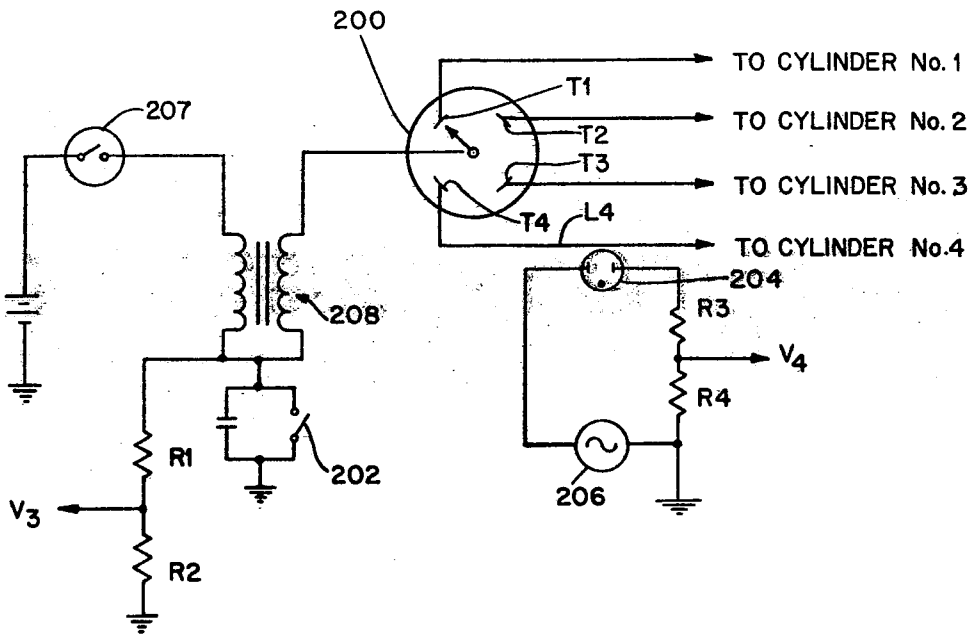
FIG. 15 is a diagram of the circuitry for providing control signals V3 and V4.

The control unit 68 receives the two control signals V3 and V4. The signal V3, which is for example a voltage from a contact point of a distributor 200 (see FIG. 15), indicates each of the ignition timing. The voltage signal V3 is derived from across the contact point 202 by means of a voltage divider R1 and R2. Thus, voltage V3 appears in response to each ignition timing of the respective cylinders. On the other hand, the control signal V4, for example, indicates an output voltage of a coil provided in the vicinity of a secondary lead extending between the distributor 200 and a spark plug of the specified cylinder (not shown). The voltage V4 is derived by means of a circuit including a neon tube 204 which is disposed adjacent to a line L4 which connects the terminal T4 of the distributor 200 to the ignition plug of the No. 4 cylinder. The neon tube is connected in series with a voltage divider R3, R4 and an alternating voltage source 206. When ignition current flows through line L4 via ignition key 207, ignition coil 208 and distributor 200, the neon tube is driven into a condition to pass current through resistors R3 and R4 to develop a voltage V4 at the junction between resistors R3, R4. Therefore, voltage V4 appears only once during a sequence of four cylinder cycles. The control unit 68, thus receiving the control signals V3 and V4, determines which cylinder is now in an air-intake process and then controls the connections between the electrodes 60, 62, 64, and 66 and the electrostatic charging means 2. In the following Tables 1–3, cylinders 1–4 are connected to the intake passages 52–58, respectively.

In the following Table 1, there is shown a manner in which the control unit 68 controls the polarities of the voltages applied to the electrodes 60, 62, 64, and 66.

Table 1

| | | | | | | | | | | |
|---|---|---|---|---|---|---|---|---|---|---|
| pulse number of signal V3 | | 1 | 2 | 3 | 4 | 5 | 6 | 7 | 8 | ... |
| pulse number of signal V4 | | 1 | | | | 2 | | | | ... |
| cylinder number under ignition | | 1 | 3 | 4 | 2 | 1 | 3 | 4 | 2 | ... |
| cylinder number under air-intake process | | 4 | 2 | 1 | 3 | 4 | 2 | 1 | 3 | ... |
| rich or lean | | R | L | R | L | R | L | R | L | ... |
| | 60 | + | − | − | − | + | − | − | − | ... |
| polarities | 62 | + | + | + | − | + | + | + | − | ... |
| of | 64 | + | − | + | + | + | − | + | + | ... |
| electrodes | 66 | − | − | + | − | − | − | + | − | ... |

In Table 1, when the control unit 68 receives the control signals V3 and V4 each of which indicates a pulse representing the firing, it is understood that the number 1 cylinder is firing and the number 4 cylinder is in an air-intake process. Therefore, if the control unit 68 applies the negative voltage to the electrode 66 and the positive voltage to the remaining electrodes, viz., 60, 62, and 64, then the air-fuel mixture fed to the cylinder connected to the passage 58 is rich. Since the firing order of the cylinders and the air-intake order of the cylinders can be previously determined, whether the air-fuel mixture fed to each of the cylinders is rich or lean is determined as shown in Table 1.

The number of the cylinders are generally even, so that, according to Table 1, two specified cylinders always receive the rich air-fuel mixture, and, on the other hand, the remaining cylinders always receive the lean air-fuel mixture. On the contrary, in the following manner according to Table 2, the four cylinders alternately receive the rich and the lean air-fuel mixture.

Table 2

| | | | | | | | | | | | | | | | | | |
|---|---|---|---|---|---|---|---|---|---|---|---|---|---|---|---|---|---|
| pulse numer of signal V3 | | 1 | 2 | 3 | 4 | 5 | 6 | 7 | 8 | 9 | 10 | 11 | 12 | 13 | 14 | 15 | 16 |
| pulse number of signal V4 | | 1 | | | | 2 | | | | 3 | | | | 4 | | | |
| cylinder number under ignition | | 1 | 3 | 4 | 2 | 1 | 5 | 4 | 2 | 1 | 3 | 4 | 2 | 1 | 3 | 4 | 2 |
| cylinder number under air-intake process | | 4 | 2 | 1 | 3 | 4 | 2 | 1 | 3 | 4 | 2 | 1 | 5 | 4 | 2 | 1 | 3 |
| rich or lean | | L | R | R | L | R | L | L | R | L | R | R | L | R | L | L | R |
| | 60 | − | + | − | − | + | − | + | + | − | + | − | − | + | − | + | + |
| polarities | 62 | − | − | + | − | + | + | − | + | − | − | + | − | + | + | − | + |
| of | 64 | − | + | + | + | + | − | − | − | − | + | + | + | + | − | − | − |
| electrodes | 66 | + | + | + | − | − | − | − | + | + | + | + | − | − | − | − | + |

As seen from the Table 2, each of the cylinders receives alternately the rich and the lean air-fuel mixture.

In the following Table 3, there will be shown another control manner of the control unit 68, which manner is similar to that of the Table 1. According to this control manner, only two electrodes 60 and 66 are used.

Table 3

| | | | | | | | | | | |
|---|---|---|---|---|---|---|---|---|---|---|
| pulse number of signal V3 | | 1 | 2 | 3 | 4 | 5 | 6 | 7 | 8 | ... |
| pulse number of signal V4 | | 1 | | | | 2 | | | | ... |
| cylinder number under ignition | | 1 | 3 | 4 | 2 | 1 | 3 | 4 | 2 | ... |
| cylinder number under air-intake process | | 4 | 2 | 1 | 3 | 4 | 2 | 1 | 3 | ... |
| rich or lean | | R | L | R | L | R | L | R | L | ... |
| polarities | 60 | + | − | − | − | + | − | − | − | ... |
| of electrodes | 66 | − | − | + | − | − | − | + | − | ... |

In the above Table 3, first, when the number 4 cylinder is in an air-intake process, the electrode 66 is negatively charged so that the rich air-fuel mixture is fed to the number 4 cylinder. Secondly, if the number 2 cylinder is in an air-intake process, the electrodes 60 and 66 both are negatively charged so that the charged fuel droplets are attracted towards the electrodes 60 and 66, resulting in the fact that the lean air-fuel mixture is fed to the number 2 cylinder. Thirdly, if the number 1 cylinder is in an air-intake process, the electrodes 60 and 66 are negatively and positively charged, respectively, so that rich air-fuel mixture is fed to the number 1 cylinder. Finally, if the number 3 cylinder is in an air-intake process, both of the electrodes 60 and 66 are negatively charged, so that the positively charged fuel droplets are attracted toward the electrodes 60 and 66, resulting in the fact that the lean air-fuel mixture is fed to the number 3 cylinder.

Figure 6A:
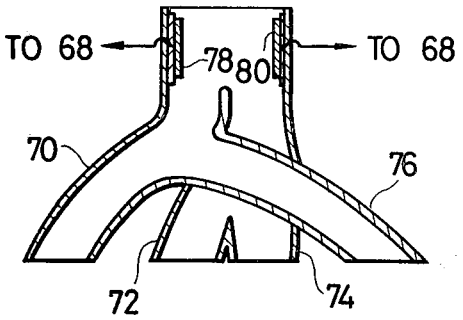
FIGS. 6*a* and 6*b* are each an elevational view, in longitudinal section, illustrating a member used in the arrangement of FIG. 5.
Figure 6B:
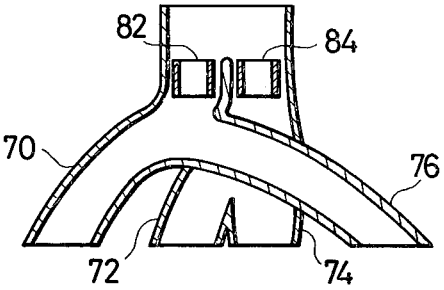

Reference is now made to FIGS. 6*a* and 6*b*, each of which illustrates a modification of a portion of the second preferred embodiment. As shown, intake passages 70, 72, 74, and 76 are separated into two sections one of which includes intake passages 72 and 74. In FIG. 6*a*, two plate-like electrodes 78 and 80 are provided upstream of the intake passages, and, on the other hand, in FIG. 6*b*, two cylindrical electrodes 82 and 84 are provided in substitution for the electrodes 78 and 80.

In the following Table 4, a control manner according to the modification of FIG. 6*a* or 6*b* is shown, wherein four cylinders 1–4 are connected to the intake passages 70–76, respectively.

Table 4

| | | | | | | | | | | |
|---|---|---|---|---|---|---|---|---|---|---|
| pulse number of signal V3 | | 1 | 2 | 3 | 4 | 5 | 6 | 7 | 8 | ... |
| pulse number of signal V4 | | 1 | | | | 2 | | | | ... |
| cylinder number under ignition | | 1 | 3 | 4 | 2 | 1 | 3 | 4 | 2 | ... |
| cylinder number under air-intake process | | 4 | 2 | 1 | 3 | 4 | 2 | 1 | 3 | ... |
| rich or lean | | R | L | R | L | R | L | R | L | ... |
| polarities of electrodes | 78 or 82 | − | − | − | − | − | − | − | − | ... |
| | 80 or 84 | + | + | + | + | + | + | + | + | ... |

As seen from the above Table 4, the electrodes 78 and 80 are always negatively and positively charged, respectively, so that the rich air-fuel mixture is always fed to the number 4 and the number 1 cylinders, and, on the other hand, the lean air-fuel mixture is always fed to the number 2 and the number 3 cylinders. Therefore, according to the control manner of the Table 4, the control unit 68 can be omitted. It is readily understood in the above that the alternative supply of the rich and the lean air-fuel mixture can be acomplished by alternatively charging negatively and positively the electrodes 78 and 80, respectively, in consideration of the above discussion in connection with the Table 2.

According to the embodiment of FIG. 5, the polarity of the voltage applied to each of the electrodes 60, 62, 64, and 66 is controlled by the control unit 68 while the electrode 14 is always positively charged. However, the FIG. 5 embodiment can be modified such that the polarity of the voltage applied to the electrode 14 is changed while the polarity of the voltage applied to each of the electrodes 60, 62, 64, and 66 is fixed. In this case, the polarity of the voltage applied to the electrode 16 should be made opposite with respect to that of the nozzle 14.

Returning to FIGS. 5, 6*a* and 6*b*, wherein if the voltage applied to each of the electrodes 60–66 and/or 14 is changed, the air-fuel ratios of the rich and the lean mixture can be changed. Furthermore it is apparent that, in the case where the voltage is not applied to the electrodes 60–66 and 14, the engine described in connection with FIG. 5 is equivalant to an ordinary one. The control unit 68 controls the voltage applied to the electrodes 60–66 and/or 14 depending upon engine operation parameters such as engine speed and an opening degree of a throttle.

Figure 7:
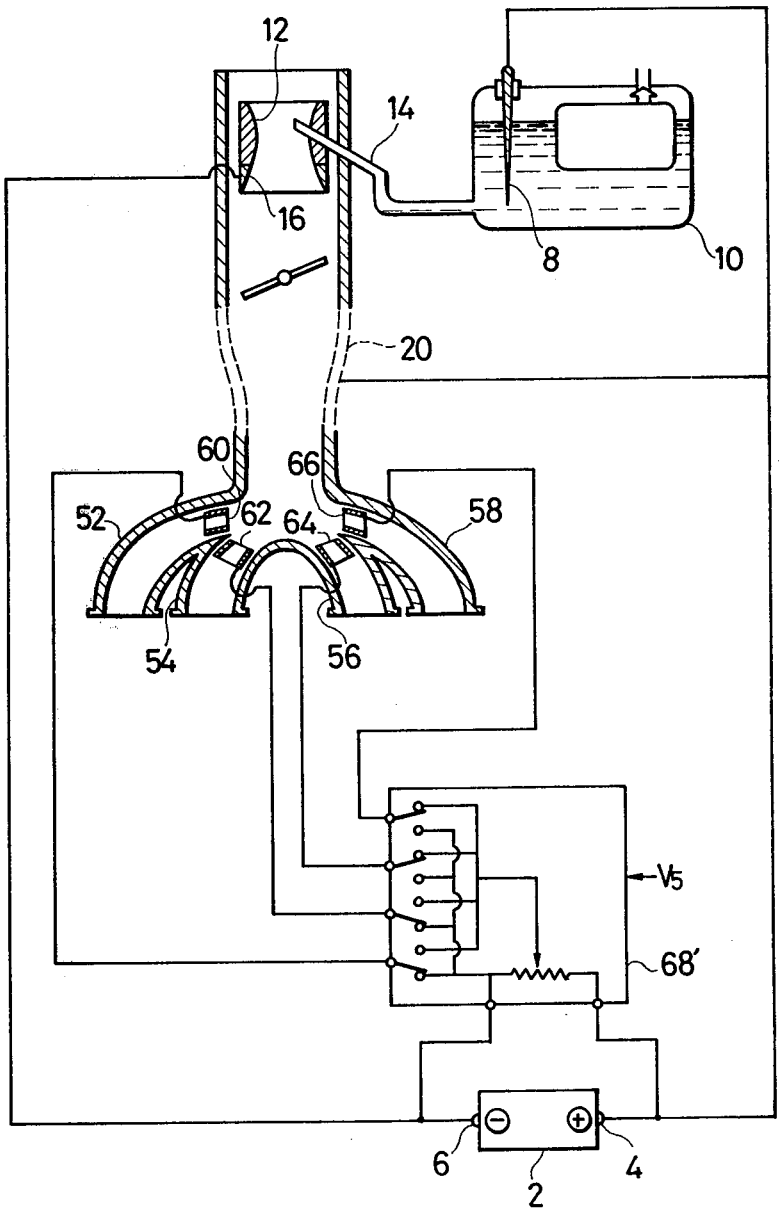
FIG. 7 illustrates a modification of the second preferred embodiment of FIG. 5.

In FIG. 7, a modification of the embodiment of FIG. 5 is shown. The difference between the arrangements of FIGS. 7 and 5 is that the control unit 68 of the latter is substituted by another control unit 68'. The control unit 68' receives a control signal V5 which represents at least one engine operation parameter such as engine speed, the amount of air intake, vacuum pressure in an intake passage, engine temperature, or concentration of component(s) of exhaust gases. The control unit 68' controls, depending upon the control signal V5, voltage and/or its polarity of each of the electrodes 60–66, thereby to be able to properly control, over broad engine operation, the air-fuel ratio of the air-fuel mixture fed to the combustion chambers (not shown). By way of example, if exhaust gas sensors (not shown), each of which generates a signal representing a concentration of a component of exhaust gases, are provided in exhaust manifolds, respectively, and supply their sensed information to the control unit 68', then, the control unit 68' controls, based upon the information received, the voltage and the polarity thereof fed to the electrodes 60–66 for accurate control of the air-fuel mixture ratio.

Figure 8:
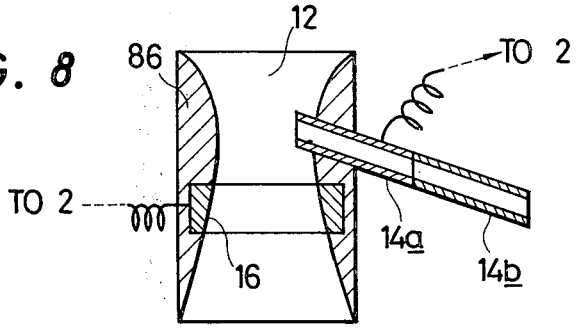
FIG. 8 is an elevational view, in longitudinal section, illustrating a member used in the arrangement of FIG. 5.

Reference is made to FIG. 8, which is a detailed illustration of the nozzle 14 and the electrode 16. The nozzle 14 consists of an electrically conductive portion 14*a* and an insulating portion 14*b*. The conductive portion 14*a* is connected to the electrostatic charging means 2. The electrode 16, which is, as shown, partially surrounded by an insulating material 86 and connected to the electrostatic charging means 2, corresponds to a portion of the venturi 12. The electrode 16 is preferably provided immediately below the nozzle 14. As previously referred to, the electrode 16 can be provided independently of the venturi 12.

Figure 9A:
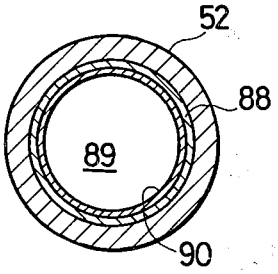
FIG. 9*a* is a sectional view of a preferred embodiment of a member, together with an intake passage, used in the arrangement of FIGS. 5, 6*b*, and 7.
Figure 9B:
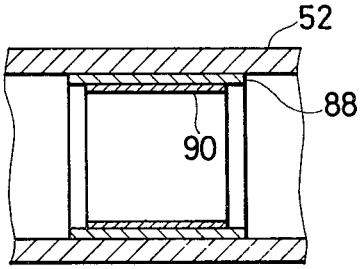
FIG. 9*b* is a side view, in longitudinal section, of the member of FIG. 9*a;*

Reference is now made to FIGS. 9*a*–10*b*, wherein there are shown two embodiments of the electrode 82 or 84 in FIG. 6*b*. FIGS. 9*a* and 9*b* illustrate a cylindrical electrode 89 which consists of a cylindrical conductive portion 90 and an insulating portion 88 surrounding the portion 90. The insulating portion 88 fits snugly within the inner wall of the intake passage such as 52.

Figure 10A:
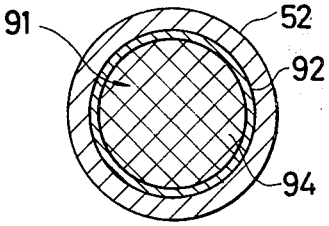
FIG. 10*a* is a sectional view of a preferred embodiment of a member, together with an intake passage, used in the arrangement of FIGS. 5, 6*b*, and 7.
Figure 10B:
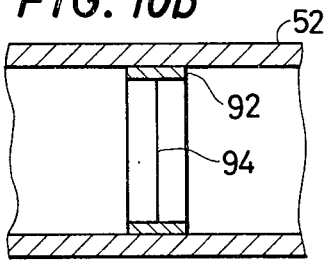
FIG. 10*b* is a side view, in longitudinal section, of the member of FIG. 10*a;*

On the other hand, FIGS. 10*a* and 10*b* illustrate another embodiment 91 of each of the electrodes 60–66, 82 and 84 (FIGS. 5, 6*b*, and 7). More specifically, the embodiment of FIGS. 10*a* and 10*b* comprises a net 94 made of electrically conducting material, being supported by a cylindrical insulating member 92 which fits snugly the inner wall of the intake passage such as 52.

Figure 11A:
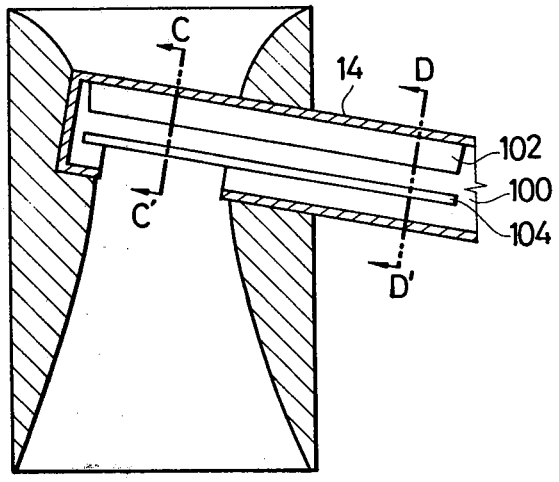
FIG. 11*a* is a modification of a member used in the first and second embodiments.
Figure 11B:
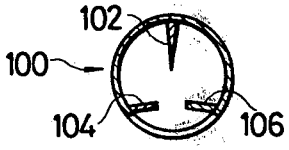
FIGS. 11*b* and 11*c* are sectional views taken along the lines C–C′ and D–D′, respectively of FIG. 11*a;*
Figure 11C:
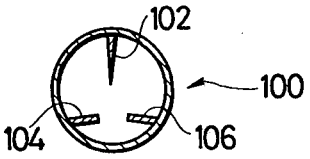

Reference is made to FIGS. 11*a*–11*c*, disclosing a preferred embodiment of an electrode assembly for effectively charging the liquid fuel. This electrode assembly, which is depicted by reference number 100, is applicable to all of the preceding embodiments. The electrode assembly 100 consists of three members 102, 104, and 106, wherein the member 102 is electrically insulated from the members 104 and 106. Although not shown, the member 104 is integral with the member 106 to form one electrode. The liquid fuel, which is carried from a float bowl (not shown), is charged by corona discharge established between the member 102 and the other members 104, 106.

Figure 12A:
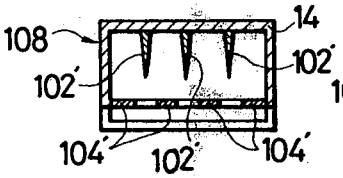
FIGS. 12*a* and 12*b* are sectional views corresponding to FIGS. 11*b* and 11*c*, but of an alternative design of the member illustrated in FIG. 11*a;*
Figure 12B:
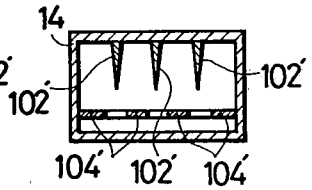

In FIGS. 12*a* and 12*b*, a modification 108 of the electrode assembly 100 is illustrated. Members 102' each correspond to the member 102 of FIG. 11*b*, and members 104' each correspond to the member 104 or 106. The modification 108 can more effectively charge the liquid fuel as compared with the electrode 100.

Figure 13A:
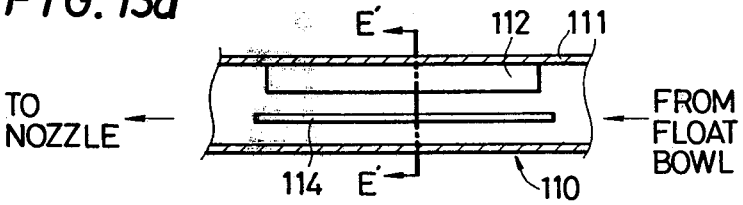
FIG. 13*a* is a modification of a member used in the first and second embodiments.
Figure 13B:
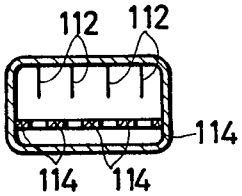
FIG. 13*b* is a a sectional view taken along line E′—E′ of FIG. 13*a;*

In FIGS. 13*a* and 13*b*, there is illustrated another preferred embodiment of an electrode assembly for effectively charging the liquid fuel. This electrode assembly, which is depicted by reference number 110, is applicable to all of the preceding embodiments. The electrode assembly 110 consists of members 112 and 114 which are electrically insulated from each other, being positioned in a fuel passage 111 extending between the nozzle 14 and a float bowl (not shown). The liquid fuel, which is carried from the float bowl, is charged by corona discharge established between the members 112 and 114.

Figure 14:
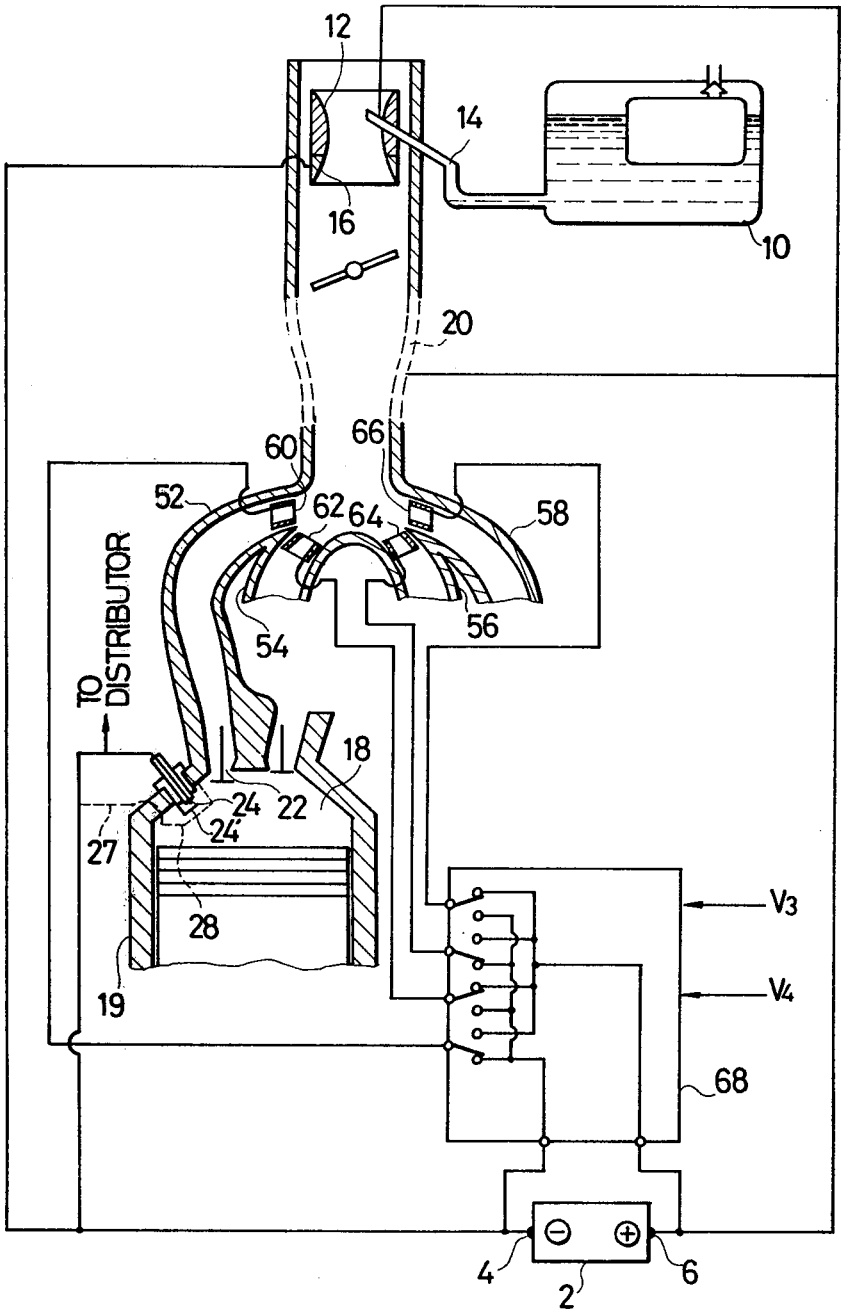
FIG. 14 is a fourth preferred embodiment of the present invention.

Finally, reference is made to FIG. 14, wherein another embodiment of the present invention is illustrated. As will be seen, the FIG. 14 embodiment is a combination of the preferred embodiments of FIGS. 1 and 5. According to this embodiment, it is understood that the firing of the lean air-fuel mixture can be easily carried out by a very simple arrangement.

What is claimed is:

1. Arrangement for use with an internal combustion engine having a plurality of combustion chambers, comprising in combination:

means for forming a combustible air-fuel mixture from a liquid fuel;

electrostatic charging means having first and second outputs for supplying first and second electrostatic charges with opposite polarity;

a first electrode connected to the electrostatic charging means for imparting the first charge to the liquid fuel to produce ionized fuel droplets in the combustible air-fuel mixture forming means;

means communicating with the combustible air-fuel mixture forming means for introducing the air fuel mixture into the combustion chambers of the internal combustion engine, said introducing means including a plurality of intake passages; and means for controlling the air-fuel mixture ratio introduced into said combustion chambers, said controlling means including a plurality of second electrodes provided in the air-fuel mixture introducing means, and means for selectively connecting each of said second electrodes to either of said first and second outputs of said electrostatic charging means, whereby one of said first and second charges is selectively applied to said second electrodes and the amount of ionized fuel droplets introduced into each of said combustion chambers is controlled by means of electrostatic forces.

2. Arrangement as claimed in claim 1, wherein said air-fuel mixture forming means includes a venturi and the first electrode comprises a fuel discharging nozzle protruding into said venturi.

3. Arrangement as claimed in claim 1, wherein the number of the second electrodes is equal to that of the combustion chambers, and at least one of said second electrodes is provided in each of the intake passages.

4. Arrangement as claimed in claim 1, wherein the number of the second electrodes is equal to that of the combustion chambers, and wherein each of the intake passages includes a diverging portion, each of the second electrodes being provided in the vicinity of said diverging portion.

5. Arrangement as claimed in claim 1, wherein said controlling means comprises means for providing that at least one of the second electrodes always receives the first charge and the remainder of the second electrodes always receives the second charge.

6. Arrangement as claimed in claim 5, wherein said controlling means controls the amount of the first and the second charges imparted to the second electrodes in accordance with at least one of the engine operation parameters.

7. Arrangement as claimed in claim 1, wherein said controlling means comprises means for providing that at least one of the second electrodes receives selectively one of the first and the second charges in response to ignition timing of the engine, and the remainder of the second electrodes receives the other charge for controlling the air fuel mixture ratio in the combustion chambers.

8. Arrangement as claimed in claim 7, wherein said controlling means controls each of the magnitudes of the first and the second charges imparted to the second electrodes in accordance with at least one of the engine operation parameters.

9. Arrangement as claimed in claim 1, wherein said controlling means comprises means for providing that at least one of the second electrodes receives alternately one of the first and the second charges in response to ignition timing of the engine, and the remainder of the second electrodes receives the other charge.

10. Arrangement as claimed in claim 9, wherein said controlling means controls each of the magnitudes of the first and the second charges imparted to the second electrodes in accordance with at least one of the engine operation parameters.

11. Arrangement as claimed in claim 1, wherein each of the second electrodes is of cylindrical configuration.

12. Arrangement as claimed in claim 1, wherein each of the second electrodes is a mesh electrode.

13. Arrangement as claimed in claim 1, wherein the number of the second electrodes is less than that of the number of the combustion chambers, each of the second electrodes being provided in the vicinity of said diverging portion.

14. Arrangement as claimed in claim 1, wherein the air-fuel mixture introducing means is bifurcated and then separated to extend to each of the combustion chambers, and wherein the number of the second electrodes is one half of the number of cylinders and each of the second electrodes is provided in the vicinity of the bifurcated portion.

15. Arrangement as claimed in claim 14, wherein there are two second electrodes and one of the two second electrodes always receives the first charge and the other always receives the second charge.

16. Arrangement as claimed in claim 14, wherein there are two second electrodes and one of the two second electrodes receives selectively one of the first and the second charges in response to an engine operation parameter indicative of air-intake processes of the combustion chambers, and the other electrode receives the other charge.

17. Arrangement as claimed in claim 16, wherein said controlling means controls each of the magnitudes of the first and the second charges imparted to the second electrodes in accordance with at least one of the engine operation parameters.

18. Arrangement as claimed in claim 1, further comprising a plurality of exhaust passages, one connected to each of the combustion chambers, and a plurality of exhaust gas sensors provided in the exhaust passages for generating a signal representative of a sensed concentration of a component of exhaust gases, and including means for controlling the voltage applied to the second electrodes in response to the signals from the exhaust gas sensors.

19. Arrangement as claimed in claim 1, wherein the combustible air-fuel mixture forming means includes a venturi, and further comprising a third electrode which is provided in the vicinity of said venturi and connected to the electrostatic charging means for receiving the second charge therefrom.

20. Arrangement as claimed in claim 1, wherein the combustible air-fuel mixture forming means includes a venturi, and further comprising a third electrode which is integral with the venturi and electrically insulated from the remainder of the venturi and connected to the electrostatic charging means for receiving the second charge therefrom.

21. Arrangement as claimed in claim 1, further comprising a fourth electrode arranged in such a manner as to face the first electrode and being connected to the electrostatic charging means for receiving the second charge and for providing corona discharge area between itself and the first electrode.

22. Arrangement as claimed in claim 21, wherein one of the first and the fourth electrodes is provided with at least one sharp edge portion and the other electrode is provided with at least one slit.

23. Arrangement as claimed in claim 22, wherein said air-fuel mixture forming means includes a venturi and fuel discharging nozzle protruding into said venturi and the first and the fourth electrodes are positioned in said fuel discharging nozzle.

24. Arrangement as claimed in claim 22, wherein the air-fuel mixture forming means includes a float bowl, a venturi and a fuel passage extending between the float bowl and the venturi, and the first and the fourth electrodes are positioned in said fuel passage.

25. Arrangement as claimed in claim 1, further comprising a fourth electrode arranged in such a manner as to face the first electrode and being connected to the electrostatic charging means for receiving the second charge and for providing corona discharge area.

26. Arrangement as claimed in claim 25, wherein one of the first and the fourth electrodes is provided with at least one sharp edge portion and the other electrode is provided with at least one slit.

27. Arrangement as claimed in claim 26, wherein the air-fuel mixture forming means includes a venturi and a fuel discharging nozzle protruding into the venturi and the first and the fourth electrodes are positioned in said fuel discharging nozzle.

28. A fuel control system for a multicylinder internal combustion engine having a main air intake passage, means for injecting fuel into said main air intake passage from an upstream portion thereof, and a plurality of passages connected from the downstream end of said main air intake passage to the combustion chambers of the engine, comprising:

means for ionizing the injected fuel in said upstream portion of said main air intake passage;

a plurality of control electrodes, at least one of said control electrodes being disposed in each of said plurality of passages; and means for selectively biasing each of said control electrodes at different potentials in response to an input signal applied thereto to control the amount of fuel introduced into each of said combustion chambers, thereby controlling the air-fuel ratio of mixture supplied thereto.

29. A fuel control system as claimed in claim 28, wherein said biasing means includes means responsive to an engine operating parameter to apply different potentials depending on the variation of the operating parameter.

30. A fuel control system as claimed in claim 29. wherein said engine operating parameter is the ignition timing of the engine.

31. A fuel control system as claimed in claim 29, wherein said biasing means comprises first means responsive to a predetermined process of each of said combustion chambers, second means responsive to said predetermined process of a specified one of said combustion chambers, and third means for sequentially applying a set of different potentials to said control electrodes in response to said first and second means to enrich and lean the mixture supplied to said combustion chambers in synchronism with each different combustion process.

32. A fuel control system as claimed in claim 28, wherein each of said electrodes is disposed in a position adjacent to the point of connection said main air intake passage and said plurality of passages.

33. A fuel control system as claimed in claim 28, wherein said biasing means comprises a voltage source having first and second terminals and means for selectively connecting said first and second terminals of said voltage source to each of said control electrodes.

34. A fuel control system as claimed in claim 28, further comprising a venturi in said main air intake passage, and wherein said injecting means comprises a nozzle in the vicinity of said venturi, and wherein said ionizing means includes means for electrically biasing said nozzle with respect to said venturi.

35. A method for controlling the air-fuel mixture ratio supplied to each combustion chamber of a multicylinder internal combustion engine having a main air intake passage, means for injecting fuel into an upstream portion of said main air intake passage, and a plurality of passages connected from the downstream end of said main air intake passage to the combustion chambers respectively, said method comprising the steps of:

(a) providing a plurality of control electrodes respectively in said plurality of passages;

(b) ionizing the fuel injected into said upstream portion;

(c) detecting a predetermined process in each of said combustion chambers;

(d) detecting said predetermined process of a specified one of said combustion chambers; and (e) biasing said control electrodes at one of a first and a second potential in response to the steps (c) and (d).

36. A method as claimed in claim 35, further comprising the step of varying the potentials applied to said control electrodes in response to an engine operating parameter.

37. A method as claimed in claim 35, further comprising the step of varying the magnitude of ionization of the injected fuel in response to an engine operating parameter.

38. A method as claimed in claim 35, wherein the step (e) comprises the step of applying said first potential to a predetermined one of said control electrodes and applying said second potential to the remainder of said control electrodes in synchronism with each of said detected process.

39. Arrangement as claimed in claim 1, further comprising a plurality of third electrodes, at least one third electrode being positioned in each of the combustion chambers of the internal combustion engine, and means for supplying said second charge from said electrostatic charging means to each of said third electrodes, whereby the air-fuel mixture in the vicinity of said third electrodes is enriched.

* * * * *